US006096183A

United States Patent [19]

Nix et al.

[11] Patent Number: 6,096,183

[45] **Date of Patent: *Aug. 1, 2000**

[54] METHOD OF REDUCING DEFECTS CAUSED BY CONDUCTOR ROLL SURFACE ANOMALIES USING HIGH VOLUME BOTTOM SPRAYS

[75] Inventors: Daniel C. Nix; John P. Sennet; Franklin H. Guzzetta, all of Middletown; Benny R. Caudill, Trenton; John M. Sebald, Middletown, all of Ohio

[73] Assignee: AK Steel Corporation, Middletown, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/985,639

[22] Filed: Dec. 5, 1997

[51] Int. Cl.[7] ..... C25D 7/06; C25D 3/56; C25D 3/22

[52] U.S. Cl. ..... 205/138; 205/246; 205/305

[58] Field of Search ..... 205/138, 220, 205/246, 305, 210

[56] References Cited

U.S. PATENT DOCUMENTS

| | | | |
|---|---|---|---|
| 3,906,895 | 9/1975 | Morino et al. | 118/326 |
| 3,988,216 | 10/1976 | Austin et al. | 204/28 |
| 3,989,604 | 11/1976 | Austin | 204/28 |
| 4,113,519 | 9/1978 | Oka et al. | 148/6.15 R |
| 4,155,816 | 5/1979 | Marencak | 204/28 |
| 4,159,926 | 7/1979 | Barnes et al. | 204/49 |
| 4,236,977 | 12/1980 | Azzerri et al. | 204/29 |
| 4,269,904 | 5/1981 | Ikeno et al. | 428/623 |
| 4,282,073 | 8/1981 | Hirt et al. | 204/28 |
| 4,313,802 | 2/1982 | Shibuya et al. | 204/28 |
| 4,351,713 | 9/1982 | Hirt et al. | 204/207 |
| 4,411,742 | 10/1983 | Donakowski et al. | 204/16 |
| 4,416,737 | 11/1983 | Austin et al. | 204/28 |
| 4,434,040 | 2/1984 | Brendlinger | 204/206 |
| 4,446,156 | 5/1984 | Salm | 428/648 |
| 4,462,911 | 7/1984 | Samhaber | 210/638 |
| 4,469,565 | 9/1984 | Hampel | 204/15 |
| 4,483,907 | 11/1984 | Salm | 428/629 |
| 4,508,480 | 4/1985 | Salm | 413/1 |
| 4,514,266 | 4/1985 | Cole et al. | 204/28 |
| 4,520,077 | 5/1985 | Lavezzari | 428/632 |
| 4,522,892 | 6/1985 | Shindow et al. | 428/628 |
| 4,540,472 | 9/1985 | Johnson et al. | 204/28 |
| 4,548,872 | 10/1985 | Lavezzari | 428/633 |
| 4,634,504 | 1/1987 | Bechem et al. | 204/28 |
| 4,645,575 | 2/1987 | Podrini | 204/28 |
| 4,650,724 | 3/1987 | Umino et al. | 428/659 |
| 4,661,213 | 4/1987 | Dorsett et al. | 204/15 |
| 4,673,468 | 6/1987 | Myers et al. | 204/24 |
| 4,702,802 | 10/1987 | Umino et al. | 204/28 |
| 4,728,401 | 3/1988 | Miyawaki et al. | 204/56.1 |
| 4,735,700 | 4/1988 | Mahr et al. | 204/211 |
| 4,765,871 | 8/1988 | Hsu et al. | 204/44.2 |
| 4,769,114 | 9/1988 | Podrini | 204/28 |
| 4,772,361 | 9/1988 | Dorsett et al. | 204/28 |
| 4,789,440 | 12/1988 | Mahr et al. | 204/28 |
| 4,804,444 | 2/1989 | Matsuda et al. | 204/28 |
| 4,804,587 | 2/1989 | Takeuchi et al. | 428/623 |

(List continued on next page.)

FOREIGN PATENT DOCUMENTS 63-250492 10/1988 Japan .

OTHER PUBLICATIONS

Hawley's Condensed Chemical Dictionary, 11th ed., pp. 1092–1093, no month available/1987.

*Primary Examiner*—Kathryn Gorgos
*Assistant Examiner*—Edna Wong
*Attorney, Agent, or Firm*—Frost & Jacobs LLP

[57] ABSTRACT

Defects in metal strips in a continuous electroplating process caused by surface anomalies in the conductor roll are reduced and/or eliminated by spraying a large volume water on the electroplated surface before it contacts the conductor roll. The water must be sprayed in a volume of at least 0.01 gallon per inch of strip width per minute per conductor roll.

10 Claims, 4 Drawing Sheets

U.S. PATENT DOCUMENTS

| | | | |
|---|---|---|---|
| 4,814,048 | 3/1989 | Suzuki et al. | 204/28 |
| 4,828,653 | 5/1989 | Traini et al. | 204/23 |
| 4,851,092 | 7/1989 | Maresch | 204/145 R |
| 4,855,021 | 8/1989 | Bersch et al. | 204/28 |
| 4,861,441 | 8/1989 | Saito et al. | 204/38.7 |
| 4,875,983 | 10/1989 | Alota et al. | 204/28 |
| 4,902,387 | 2/1990 | Takeuchi et al. | 204/28 |
| 4,923,573 | 5/1990 | Florian | 204/28 |
| 4,952,287 | 8/1990 | Alota et al. | 204/28 |
| 4,986,291 | 1/1991 | Hula et al. | 134/122 R |
| 5,000,828 | 3/1991 | Shindou et al. | 204/28 |
| 5,009,750 | 4/1991 | Hula et al. | 204/13 |
| 5,011,744 | 4/1991 | Saito et al. | 428/623 |
| 5,022,968 | 6/1991 | Lin et al. | 204/28 |
| 5,022,971 | 6/1991 | Maresch et al. | 204/145 R |
| 5,032,236 | 7/1991 | Saitou et al. | 204/27 |
| 5,082,748 | 1/1992 | Ahn et al. | 428/656 |
| 5,100,522 | 3/1992 | Hula et al. | 204/208 |
| 5,130,000 | 7/1992 | Maresch et al. | 204/145 R |
| 5,246,563 | 9/1993 | Maresch et al. | 205/141 |
| 5,273,643 | 12/1993 | Hasegawa et al. | 205/155 |
| 5,292,374 | 3/1994 | Maresch et al. | 134/3 |

METHOD OF REDUCING DEFECTS CAUSED BY CONDUCTOR ROLL SURFACE ANOMALIES USING HIGH VOLUME BOTTOM SPRAYS

FIELD OF THE INVENTION

This invention relates to a method of continuously electroplating metal strips. In particular, it relates to a method for reducing conductor roll surface anomalies that produce defects in electroplated surfaces.

BACKGROUND OF THE INVENTION

Numerous processes for continuously electroplating metal strips have been developed, and a variety of such processes are used commercially. Traditional continuous electroplating processes involve fully submersing a metal strip in an electrolyte solution and applying current to deposit metal ions from the electrolyte solution onto the metal strip, thus forming a coated surface. In the traditional processes, the metal strip traverses the electrolyte solution in a generally horizontal direction, generally vertical direction, or at an angle between these two directions. In most commercial electroplating processes, a plurality of electroplating units (cells) are arranged in series so that the metal strip traverses the electrolyte in a first cell, where it is electroplated, and from there enters into a second cell, where additional coating is added, and so on.

An approach which is different from the traditional electroplating processes is disclosed in U.S. Pat. No. 4,469,565, issued to Hampel, on Sep. 4, 1984 (Hampel). The Hampel patent discloses electroplating of a continuous metal strip using the surface as a cathode and a non-horizontal plate as an anode. The electrolyte is continuously supplied into a space between the metal strip and the anode plate so as to fill completely the space with the electrolyte. The electrolyte in the space between the metal strip and the anode plate continuously flows downward from the force of gravity and is continuously replenished by additional electrolyte supplied into the space.

In most continuous electroplating processes, after the coated metal strip exits the electrolyte solution, it contacts a conductor roll. Typically the metal strip is wrapped around at least a portion of the conductor roll so that the metal strip contacts the conductor roll with some force.

As a result of this contact with the conductor roll, defects can be produced in the metal strip due to imperfections in the conductor roll surface. Some of the imperfections in the conductor roll surface are attributable to the electrolyte solution, which is generally acidic. For example, metal ions in the electrolyte solution can plate onto the conductor roll surface and the electrolyte solution can etch the conductor roll surface. The electrolyte solution can produce anomalies in the surface of the conductor roll. By diluting the electrolyte solution with large quantities of water, the method of the present invention reduces defects in the metal strip that result from the action of the electrolyte solution on the conductor roll.

Unexpectedly, the method of the present invention also reduces and/or eliminates conductor roll surface anomalies that are created in the material of the conductor roll itself and do not appear to be connected to the electrolyte solution. For example, surface finish defects that result from arcing, wherein the metal of the conductor roll is melted and displaced; grooves that are worn into the conductor roll surface; and defects that are called "dot dents," which are random areas of raised metal consisting of the metal of the conductor roll, are significantly reduced and/or eliminated when a large quantity of water rinses the electroplated metal strip before it contacts the conductor roll.

SUMMARY OF THE INVENTION

The present invention provides a method of reducing defects on a metal strip in a continuous electroplating process comprising the step of spraying water at a rate of at least about 0.01 gallon per inch of strip width per minute per conductor roll on an electroplated surface before the surface contacts a conductor roll.

DETAILED DESCRIPTION OF THE INVENTION

Conductor roll defects can be reduced or even eliminated by spraying water on an electroplated surface before it contacts the conductor roll. The method of the present invention can be used with most continuous electroplating processes.

Figure 1:
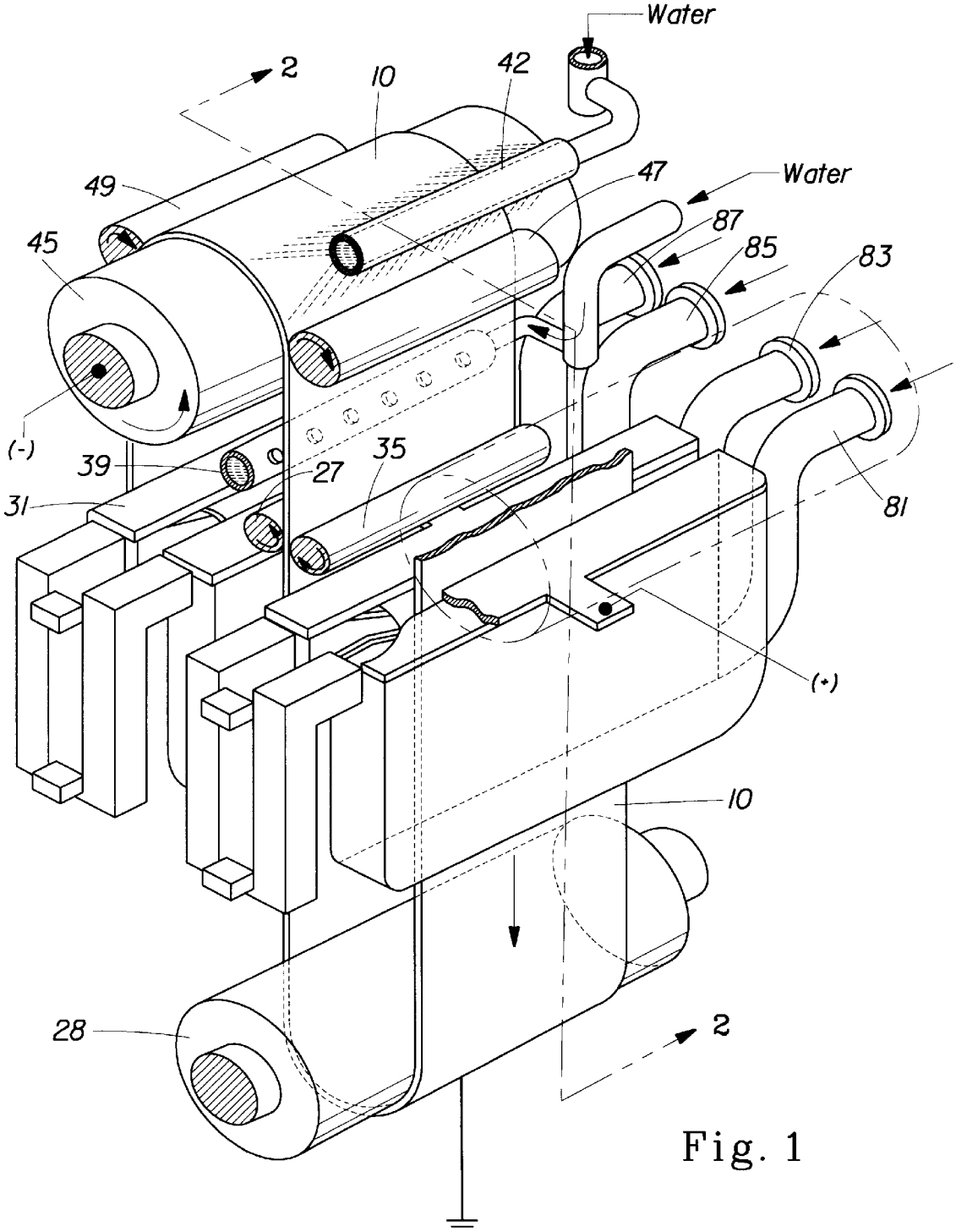
FIG. 1 is a perspective view of a Hampel electroplating cell.
Figure 2:
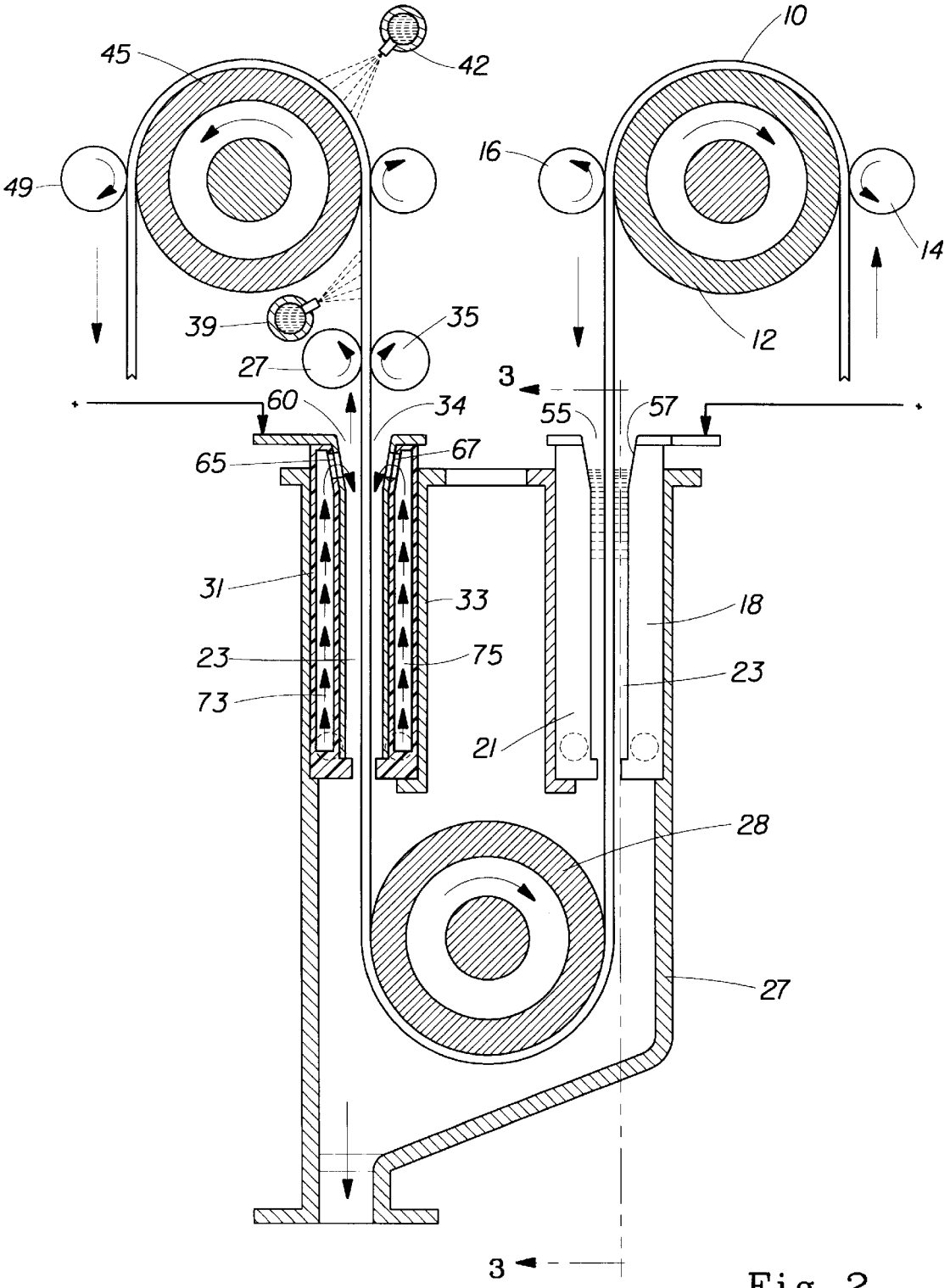
FIG. 2 is a cross-sectional view of the cell of FIG. 1 along the line 2—2 thereof.
Figure 3:
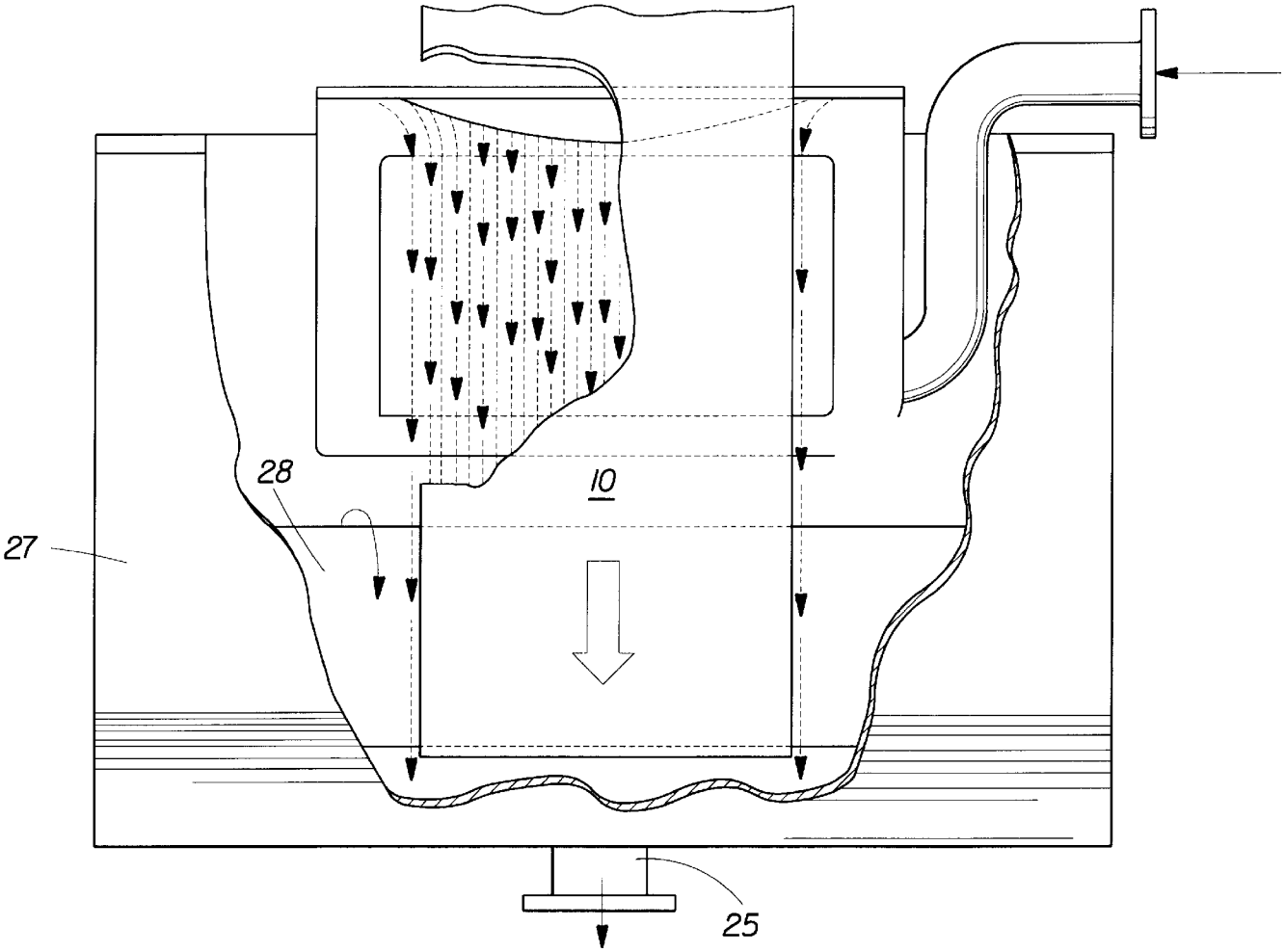
FIG. 3 is a view, partially in cross-section, of the cell of FIG. 2 along the line 3—3 thereof.

FIGS. 1 to 3 depict a cell of a coating line for electroplating a metal strip using the Hampel process. A commercial line typically has more than one cell, and can include about 10 to about 30 cells. As shown in FIGS. 1 and 2, the metal strip is carried forward by a roll 12 (Phantom in FIG. 1), which is rotating in a counter-clockwise direction. The rolls 14 and 16 (not shown in FIG. 1) on either side of the roll 12 help to maintain the metal strip against the face of the roll.

As shown in FIG. 2, from the roll 12, the metal strip 10 travels downward into a space between the anode boxes 18 and 21. The space between the anode boxes 18 and 21 is filled with an electrolyte 23.

As shown in FIG. 1, the electrolyte 23 is supplied through a pipe 87. As shown in FIG. 2, the electrolyte flows into a chamber 73 and then into the space 60, as shown in FIG. 3. The electrolyte is supplied to the space 34 in a similar manner: it flows through the pipe 85 into the chamber 75 and out of the opening 67 into the space 34. Similarly, the electrolyte 23 flows into a chamber (not shown) 18 and through an opening (not shown) into the space 57. Finally, as shown in FIGS. 1 to 3, the electrolyte 23 flows through the pipe 83 into a chamber (not shown) 21 and from there, through an opening (not shown) into the space 55. The electrolyte continuously flows downward between the anode boxes 18 and 21 and the metal strip 10. The metal strip 10 travels over the conductor roll 12 and then travels downwardly between the anode boxes 18 and 21. The metal strip 10 is negatively charged and the anode boxes 18 and 21 are positively charged. A sufficient electrical potential exits between the anode boxes 18 and 21 and metal strip 10 to cause coating metal ions in the electrolyte 23 to deposit onto the surfaces of the metal strip 10 that are in contact with the electrolyte 23. The deposited coating metal ions form a coating on the metal strip 10. The electrolyte 23 flows out of the space between the anode boxes 18 and 21 and flows downwardly into the bottom opening defined by the cell wall 27. The electrolyte is then regenerated and recycled (not shown). A fresh or regenerated electrolyte is continuously fed into the top of the space between the anode plates 18 and 21 to replace the electrolyte that is continuously flowing downward into the opening.

The metal strip 10 exits the space between the anode boxes 18 and 21 and travels downwardly onto a sink roll 28. From the sink roll 28, the metal strip 10 travels upwardly into a space between anode boxes 31 and 33. This space is filled by the electrolyte 23 which is continuously flowing downward until it flows into the opening 25 and is continuously replaced by fresh or regenerated electrolytes fed into the top of the space between the anode boxes 31 and 33. The anode boxes 31 and 33 are positively charged and the metal strip 10 is negatively charged. The resulting electrical potential causes coating metal ions to deposit on the surface of the metal strip that are in contact with the electrolyte 23 in the gap between the anode boxes 31 and 33. The coating metal ions deposited on the metal strip 10 increase the thickness of the original coating produced by electroplating between the anode boxes 21 and 23.

It should be noted that if coating on only one side of the metal strip 10 is desired, the anode box on the side of the metal strip that is not to be coated is removed from service. The electroplating then occurs only on the side of the metal strip that is facing the anode plate that is charged.

The metal strip 10 exits from the electrolyte 23 in the space between the anode boxes 31 and 33 and moves upwardly guided by rolls 35 and 27. The metal strip 10 is sprayed with water by spray assembly 39 on at least the side that will contact the conductor role 45. The metal strip 10 may also be sprayed on the side not contacting the conductor roll 45 by a spray assembly 42.

The spray assembly 39 may be located anywhere along the path of travel of the metal strip 10 so long as it sprays the side of the metal strip 10 that will contact the conductor roll 45. It must spray the metal strip 10 after it leaves the electrolyte solution 23 and before it contacts the conductor roll 45.

The spray assembly may be of any configuration. Spray assemblies are well known in the art. It is important that the spray assembly be configured so that it sprays water across the entire width of the metal strip.

Each electroplating cell typically includes one conductor roll. For each conductor roll, water must be sprayed from the spray assembly at a rate of at least about 0.014 gallons per inch of strip width per minute per conductor roll (0.02 liters per centimeter of strip width per minute per conductor roll). For example, for a metal strip 65 inches wide (165 centimeters), at least 0.91 gallons (3.3 liters) of water must be sprayed each minute for each conductor roll. The more concentrated the metal ions in the electrolyte are, the greater volume of water may be required. The volume of water necessary to practice the present invention can vary depending on the type of metal ion in the electrolyte solution. For example, a solution containing zinc and nickel requires a greater volume of water to be sprayed than a solution containing only zinc. Also, the more nickel relative to the zinc contained in the solution, the more water is required.

Preferably, for an electrolyte solution containing zinc, water is sprayed at a volume of at least about 0.02 gallons per inch of strip width per minute per conductor roll (about 0.03 liters per centimeter of strip width per minute per conductor roll). More preferably, water is sprayed at a volume of about 0.027 to about 0.046 gallons per inch of strip width per minute per conductor roll (about 0.04 to about 0.07 liters per centimeter of strip width per minute per conductor roll).

Preferably, for an electrolyte solution containing zinc and nickel with a nickel to zinc ratio of about 1.4 to about 1.5 by weight, water is preferably sprayed at a volume of at least about 0.03 gallons per inch of strip width per minute per conductor roll (about 0.045 liters per centimeter of strip width per minute per conductor roll). More preferably, water is sprayed at a volume of at least about 0.045 gallons per inch of strip width per minute per conductor roll (about 0.067 liters per centimeter of strip width per minute per conductor roll).

The term "water" as used herein encompasses any type of an aqueous medium including water from a municipal water supply, plant cooling water, water treated with acidifying or other treating or preserving agents, and deionized water. Preferably, the water is deionized water.

The metal strip that can be used in connection with the present invention can be made of any metal that can be plated. Preferably, the metal strip is made of carbon steel. The metal strip can be of any width. Typically, metal strip is about 12 to about 75 inches (about 30 to about 190 centimeters) wide. Preferably, the strip is about 36 to about 75 inches (about 90 to about 190 centimeters) wide.

The present invention is applicable to processes using any electrolyte solution. Generally, zinc electrolytes include about 60 to about 200 grams of zinc per liter of electrolyte, about 3 to about 20 grams of acid per liter of electrolyte and water. Generally, zinc alloy electrolytes include about 60 to 200 grams of metal (zinc plus alloying metal) per liter of electrolyte, about 3 to about 20 grams of acid per liter of electrolyte and water. Often the electrolyte includes conductive salts, such as sodium or magnesium sulfate. Preferably, the zinc electrolyte comprises about 90 g/l zinc, 7 g/l sulfuric acid and water. The electrolyte is generally at a temperature is from about 100° F. to about 160° F. (about 37° C. to about 71° C.).

EXAMPLE

Figure 4:
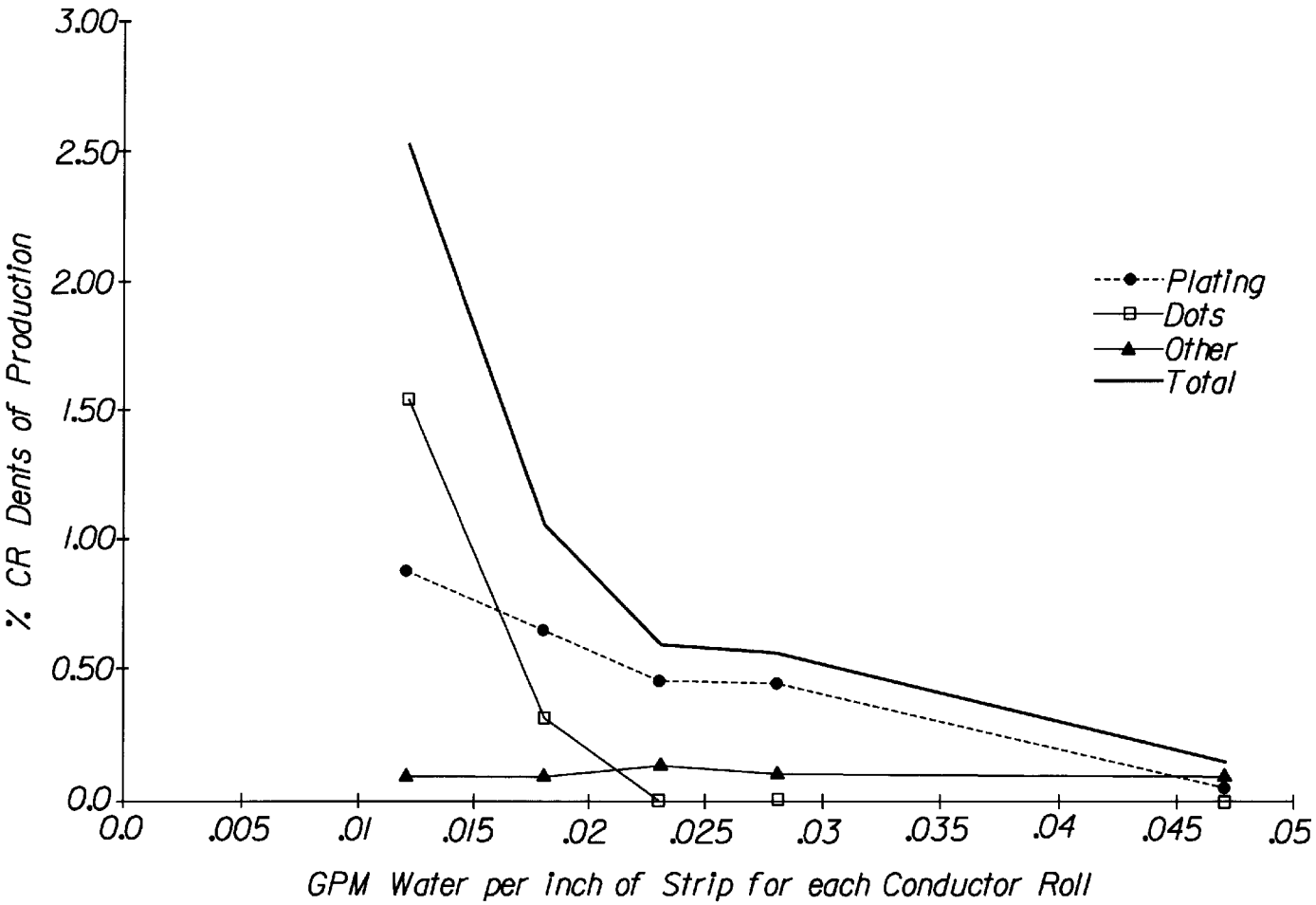
FIG. 4 is a graph of the reduction in conductor roll defects relative to water flow rate.

FIG. 4 illustrates the effect on conductor roll surface anomalies of spraying water onto an electroplated surface, in accordance with the present invention. The data presented indicates the percentage of production material that contained an objectionable defect caused by an imperfection on a conductor roll (e.g., plating, dot dents, etc.). This data was collected over the course of several manufacturing runs, wherein approximately 80% of the runs used zinc as the coating metal on steel strip and approximately 20% of the runs used zinc/nickel as the coating metal on steel strip. The steel strip was coated on a Gravitel® continuous plating line. The plating conditions were as follows:

| | | |
|---|---|---|
| Zinc Coating | | |
| Zinc Concentration | 80–100 g/l | |
| pH | 1.0–1.5 | |
| Electrolyte Temperature | 125–140° F. | |
| Line Speed | Average = 520 fpm | Maximum = 600 fpm |
| Number of Plating Cells | > = 60 | |
| Zinc/Nickel Coating | | |
| Nickel/Zinc Ratio | 1.2–1.6 | |
| Total Metal (Ni + Zn) | 70–90 g/l | |
| pH | 1.0–1.5 | |
| Electrolyte Temperature | 135–145° F. | |
| Line Speed | Average = 585 fpm | Maximum = 600 fpm |
| Number of Plating Cells | Average = 30 | |

What is claimed is:

1. A method of reducing defects on a metal strip in a continuous electroplating process using at least one electrolyte solution, comprising the step of spraying water at a rate of at least 0.014 gallons per inch of strip width per minute per conductor roll on an electroplated surface before the surface contacts a conductor roll.

2. A method in accordance with claim 1, wherein the electrolyte solution comprises zinc.

3. A method in accordance with claim 2, wherein the water is sprayed at a volume of at least about 0.02 gallons per inch of strip width per minute per conductor roll.

4. A method in accordance with claim 3, wherein the water is sprayed at a volume of about 0.027 to about 0.046 gallons per inch of strip width per minute per conductor roll.

5. A method in accordance with claim 1, wherein the electrolyte solution comprises zinc and nickel.

6. A method in accordance with claim 5, wherein the ratio of nickel to zinc is about 1.4 to about 1.5 by weight.

7. A method in accordance with claim 6, wherein the water is sprayed at a volume of at least about 0.03 gallons per inch of strip width per minute per conductor roll.

8. A method in accordance with claim 7, wherein the water is sprayed at a volume of at least about 0.045 gallons per inch of strip width per minute per conductor roll.

9. A method in accordance with claim 1, wherein said water is deionized water.

10. A method in accordance with claim 1, wherein the metal strip comprises carbon steel.

* * * * *